US009636885B2

(12) United States Patent
Boegli et al.

(10) Patent No.: US 9,636,885 B2
(45) Date of Patent: May 2, 2017

(54) DEVICE FOR EMBOSSING PACKAGING MATERIAL WITH A SET OF EMBOSSING ROLLERS OF THE MALE-FEMALE DIE TYPE

(71) Applicant: Boegli Gravures SA, Marin-Epagnier (CH)

(72) Inventors: Charles Boegli, Marin-Epagnier (CH); Werner Steffen, Stans (CH); Alain Droz, Thielle (CH)

(73) Assignee: Boegli-Gravures S.A., Marin-Epagnier (CH)

( * ) Notice: Subject to any disclaimer, the term of this patent is extended or adjusted under 35 U.S.C. 154(b) by 0 days.

(21) Appl. No.: 14/908,144

(22) PCT Filed: Aug. 26, 2014

(86) PCT No.: PCT/IB2014/064069

§ 371 (c)(1),
(2) Date: Jan. 28, 2016

(87) PCT Pub. No.: WO2015/028939

PCT Pub. Date: Mar. 5, 2015

(65) Prior Publication Data

US 2016/0200066 A1 Jul. 14, 2016

(30) Foreign Application Priority Data

Aug. 28, 2013 (EP) ..... 13181978

(51) Int. Cl.
*B31F 1/07* (2006.01)
*B44B 5/02* (2006.01)

(52) U.S. Cl.
CPC ..... *B31F 1/07* (2013.01); *B44B 5/026* (2013.01); *B31F 2201/0725* (2013.01);
(Continued)

(58) Field of Classification Search
CPC ..... B31F 1/07; B31F 2201/072; B31F 2201/0733; B31F 2201/0741;
(Continued)

(56) References Cited

U.S. PATENT DOCUMENTS 4,280,978 A 7/1981 Dannheim et al.
5,007,271 A 4/1991 Boegli
(Continued)

FOREIGN PATENT DOCUMENTS

DE 19734414 2/1999
EP 0114169 B1 8/1984
(Continued)

OTHER PUBLICATIONS

International Search Report of Jan. 19, 2015 for PCT/IB2014/064069.
Written Opinion of the International Search Authority of Jan. 19, 2015 for PCT/IB2014/064069.

*Primary Examiner* — Jill Culler
*Assistant Examiner* — Marissa Ferguson Samreth
(74) *Attorney, Agent, or Firm* — Andre Roland S.A.; Nikolaus Schibli

(57) ABSTRACT

The embossing device for embossing packaging material comprises a set of embossing rollers with male die and female die rollers co-operating with one another, the surface of which is provided with texture elements, wherein the texture elements (M6R6) on the surface of the female die roller (M6), which are assigned to the texture elements (P6E6) on the surface of the male die roller (P6) are not inversely congruent by an amount of above 15 μm in axial and radial direction and the texture elements of the male die and female roller associated with one another comprise facets (F) for the purpose of local pressure elevation. A facet (F) comprises faces (FN), which with respect to the imaginary, continuous surface of the texture is inclined. With such
(Continued)

facetted rollers, a very large variety of films can be embossed in an aesthetically appealing manner, wherein the films can be mainly employed in the tobacco and foodstuff industry.

16 Claims, 12 Drawing Sheets

(52) U.S. Cl.
CPC ..... *B31F 2201/0733* (2013.01); *B31F 2201/0738* (2013.01); *B31F 2201/0741* (2013.01); *B31F 2201/0743* (2013.01); *B31F 2201/0774* (2013.01)

(58) Field of Classification Search
CPC ..... B31F 2201/0725; B31F 2201/0738; B31F 2201/0743; B31F 2201/0774; B65B 19/228; B23K 26/362; B44B 5/026
See application file for complete search history.

(56) References Cited

U.S. PATENT DOCUMENTS

| | | | | |
|---|---|---|---|---|
| 5,269,983 | A * | 12/1993 | Schulz | B31F 1/07 162/109 |
| 5,779,965 | A * | 7/1998 | Beuther | A61F 13/15731 264/280 |
| 6,080,276 | A * | 6/2000 | Burgess | B31F 1/07 162/109 |
| 6,440,564 | B1 * | 8/2002 | McLain | B31F 1/07 156/219 |
| 6,665,998 | B1 * | 12/2003 | Boegli | B31F 1/07 101/22 |
| 7,036,347 | B2 | 5/2006 | Boegli | |
| 2011/0308754 | A1 * | 12/2011 | McNeil | D21F 11/008 162/286 |

FOREIGN PATENT DOCUMENTS

| | | |
|---|---|---|
| WO | WO00/56475 | 9/2000 |
| WO | WO2013/158256 | 10/2013 |

* cited by examiner

FIG. 2
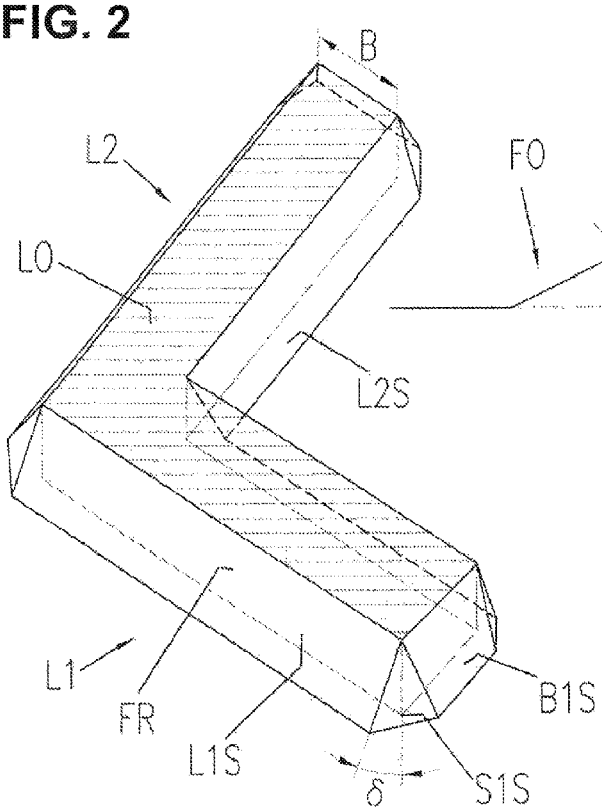
FIG. 2B
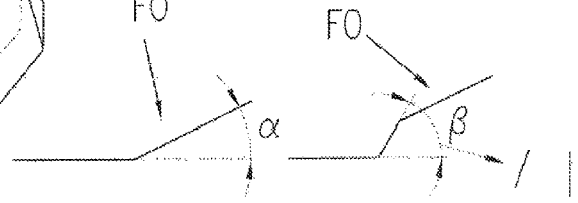
FIG. 2C
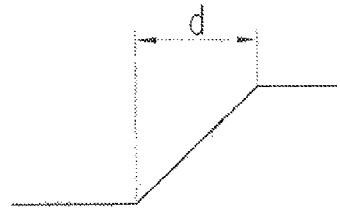
FIG. 2A
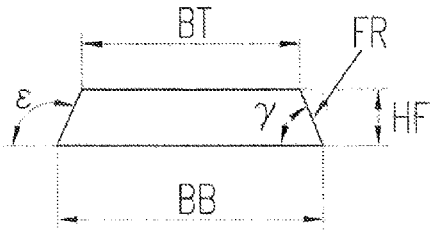
FIG. 2D
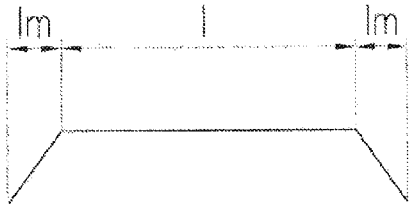
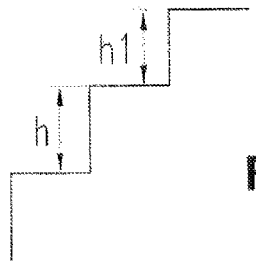
FIG.2E

DEVICE FOR EMBOSSING PACKAGING MATERIAL WITH A SET OF EMBOSSING ROLLERS OF THE MALE-FEMALE DIE TYPE

CROSS-REFERENCE TO RELATED APPLICATIONS

The present application is a U.S. national stage application of PCT/IB2014/064069 filed on Aug. 26, 2014, and claims foreign priority to European patent application EP 13181978.1 filed on Aug. 28, 2013, the contents of both documents being herewith incorporated by reference in its entirety.

The present invention relates to a device for embossing packaging material with at least two embossing rollers, according to the preamble of patent claim 1.

Packaging films for the tobacco industry or for the foodstuff industry have already been embossed with embossing roller devices for some time, which can be for example so-called inner liners which are wrapped about a number of cigarettes, or packaging material for chocolate, butter or similar foodstuff, electronic components, jewellery or watches.

The so-called inner liners initially consisted of pure aluminium foils, such as for example household foil, and these were embossed by being passed through between two rollers, of which at least one roller comprised a relief, the so-called logos. Up to approximately 1980 such a roller pair by majority consisted of a steel roller, on which a relief was moulded and of a mating roller of a resilient material, for example rubber, paper or perspex. By pressing the relief of the male die roller into the mating roller=female die roller the mirror image impression was produced.

Representative of this EP 0 114 169 A1 is mentioned, which discloses a male die with protrusions and a female die with associated recesses, wherein the recesses are slightly larger and can also comprise steps and are created by means of a laser. As material of the mating roller, hard rubber is mentioned, while the term "hard" although mentioned in the document is not explained however. In addition, this device is intended to be operated only in a rotogravure printing press, i.e. without pressure or only with the pressure of this machine.

For more sophisticated logos, the relief of the male die roller was transferred to a layer on the female die roller and the recesses corresponding to the raised locations were etched out or created otherwise. In recent times, laser was also used for this gravure.

Since producing female die rollers for sophisticated logos is complicated, a so-called pin-up—pin-up system established itself from approximately 1980 following the registration of U.S. Pat. No. 5,007,271 of the same applicant, wherein two identical steel rollers with a very large number of small teeth engage into one another and emboss an inner liner being passed through in between. Logos are produced with this device in that teeth on a roller are entirely or partly removed.

Because of this it also became possible to create the so-called satin-finishing, wherein through the large number of small recesses, which were caused through the teeth, the previously shining surface is given a matt and therefore also nobler appearance.

Parallel with the developments of the embossing technique, or the production of the embossing rollers, a change in the packaging materials also came to pass, wherein the originally all-metal aluminium foils were replaced by paper films, the surfaces of which were coated with ever thinner metal layers out of environmental considerations, wherein most recently the metal layer was sputtered on. Lately and also in the future, metalizing of the inner liners will become even less or disappear entirely.

Simultaneously with this, efforts are underway to get away from the classic packaging system of inserting cigarettes packed into inner liners and inserting this package into a cardboard casing towards so-called soft packages, wherein merely a wrapping film is provided which assumes both functions, namely keeping the cigarettes moist and protection from external influences of smell on the one hand and a certain stiffness for the mechanical protection of the cigarettes on the other hand.

The developments in the production of the embossing rollers, in particular known by the same applicant, see for example U.S. Pat. No. 7,036,347, led to an ever greater scope of decorative effects on the inner liners and to a greater technical availability for advertising purposes, which was employed not only in the cigarette industry but also in the foodstuff industry. Of late, efforts are underway however to greatly reduce or entirely eliminate advertising for tobacco goods, so that embossing the inner liners with designs having advertising appeal will no longer be possible to the extent as before. For this reason, ways are increasingly sought to create new decorative effects without using noticeable embossing, gold edges or similar embellishments.

New ways for the product identification are also sought, which up to now was ensured above all in trade names that were maintained worldwide. Today, so-called tactile effects are employed for example which are created through special surface textures of the papers or through special gravures. Textiles like papers are provided with blowable inks which are optimised for IR-absorption, which creates so-called pseudo embossing. The purpose of this technology can be a palpable relief formation in order to create for example a velvet-like surface or a matt effect. When used for food-safe purposes, wetting techniques however are questionable.

In the case of tactile surfaces, the consumer identifies the product through his sense of touch. Apart from this, this can lead to the use for Braille or for creating hidden safety features. Tactually generated information can for example be read out by means of laser beams or the reflectiveness dependent on the surfaces. There are currently also developments which aim at creating acoustically audible effects through the stroking of the surface.

Another area of the tobacco industry deals with the cigarette itself, for example with its mouthpiece, also called tipping.

Legislation regarding tobacco products which has an ever more restrictive effect and the endeavour of further features such as tactile, acoustic or other visual features on the one hand and the ever greater variety of different types of packaging materials such as aluminium films, metal-coated papers, tipping papers, hybrid films, plastic films, cardboard or semi-cardboard on the other hand result in that the pin-up—pin-up embossing rollers, in the case of which both the driven roller as well as the mating roller can have a large number of teeth, can be continued to be fully and successfully employed for the embossing of inner liners, but come up against their limits for the objectives indicated above.

Known roller systems with a male die roller with male die textures and a female die roller with female die textures that are inversely congruent thereto can expand the area of decorative elements but are highly cost-intensive and above all time-consuming to produce as a consequence of the production and sorting by pairs so that their production is not suitable for industrial embossing of for example metallized inner liners for the tobacco industry.

Apart from this, fine embossing can only be ensured with a very great expenditure in the production of such rollers. Added to this is that in the case where a male die roller and a female die roller which is inversely congruent thereto are used, the film located in between is squashed during the embossing in such a manner that stresses develop in the transverse direction, which are unacceptable for tobacco product papers. Apart from this, a limit for the perforation that is difficult to control and very high pressures are necessary for a high-speed online process, where the embossing times are in the millisecond range. Finally there is a tendency of using thicker papers.

In the not pre-published patent application PCT/EP 2013/056144 it is proposed for solving the general idea of stating a method for producing a set of embossing rollers with which it is possible to carry out fine embossing for a wide range of described surface textures of the wide range of stated materials in online operation of a packaging plant that in a male-female embossing roller system the female die surface texture is produced independently of a male die surface texture that has already been created beforehand or that physically already exists.

In the case of fine textures this statement is sufficient for this type of production makes possible a very large variety of configuration possibilities.

However, in the case that relatively larger freely formed surfaces of logos are concerned, their embossing with satisfactory aesthetic quality is problematic. In order to ensure that these surfaces for example in the case of inner liners have the same reflectiveness everywhere the same minimal specific embossing pressure has to be expended everywhere. However, this is not possible without suitable measures when there are minute local deviations of the geometry between male die and female die rollers, which let the local embossing pressure vary greatly. In the case of tolerances that are too close and high pressures, embossing creates holes. High pressures can negatively affect the sandwich texture of an inner liner which at elevated temperatures results in the degradation of the same due to a varnish stain being formed on the back of the paper.

The maximum pressure that can be practically applied without greater expenditure today is around for example 3,000 N/per an area of 150 mm times 1 mm; roller length times embossed width on a roller of approximately 70 mm diameter. The paper thickness which by nature varies locally in the case of cellulose cannot be compensated either.

If many freely shaped patterns are present on the same roller surface, the paper can easily crumple because of locally different paper stretch. The high sampling density that is required today increases this problem even further.

Starting out from this prior art it is the object of the present invention to state an embossing device with an embossing roller set having at least two male die and female die rollers which cooperate with one another, which does not only allow carrying out fine embossing for a wide range of described surface textures of the wide range of material types in online operation of a packaging plant but additionally the high-quality eye-catching fine embossing of sophisticated logos such as for example mythical creatures, letters and the like. This object includes the creating of stepped grades of brilliance and of stepped contouring. Such a device is defined in the independent patent claim 1.

In general, fine embossing is to mean that the contours of the fine embossing textures of the rollers have a linear total error in axial and radial direction of less than +/−10 μm and/or an angle error of less than 5°.

Further objects and advantages are obtained from the dependent claims and the following description. In the following, the invention is explained in more detail with the help of drawings of exemplary embodiments.

FIG. 1 shows schematically a device with a set of embossing rollers with a male die and a female die, each of which are provided with a simple texture, FIG. 1A shows schematically a facetted rounding, FIGS. 2, 2A show schematically a sign with facets, FIGS. 2B-2E illustrate schematically four rules for facets, FIGS. 3-5 show schematically sectional drawings of designs of male die and female die textures which are not inversely congruent, FIG. 6 shows a second device with a set of embossing rollers with a male die and a female die, on which the texture consists of a sophisticated figure, FIG. 7 shows a further device with a set of embossing rollers, which are provided with a sophisticated figure, FIG. 8 shows a detail enlargement from FIG. 4, FIG. 9 shows a texture on a male die roller, FIG. 10 shows a further texture on a male die roller, FIG. 11 shows a further exemplary embodiment of an embossing set, FIG. 12 shows an exemplary embodiment of an embossing set with a male die roller and two associated female die rollers, FIG. 13 shows a further embossing roller set with a female die roller and two associated male die rollers, FIG. 13A shows the use of a female die roller with a male die roller, FIG. 13B shows the use of the same female die roller with another male die roller, FIG. 14 shows an embossing device with a female die roller and two male die rollers, FIGS. 15A, B show two schematic sections of the rollers from FIG. 14, FIG. 16 shows a further stamping device with a female die roller and two male die rollers, FIG. 17 shows a further stamping device with a female die roller and two male die rollers, FIG. 18 shows schematically a first exemplary embodiment of a quick-change device for rollers according to the invention in a perspective view, FIG. 19 shows the assembled device from FIG. 18 in a section, FIG. 20 shows schematically a second exemplary embodiment of a quick-change device for rollers according to the invention in a perspective view.

FIG. 1 shows schematically and simplified a construction of an embossing device 1 with a male die roller P1 and a female die roller M1, wherein the male die roller is driven by a drive 2. The male die roller P1 comprises two elevations P1E1 and P1E2 which are different from one another and the female die roller M1 comprises recesses M1R1 and M1R2 which are assigned to the elevations of the male die roller. Since the textures of the female die rollers are produced independently of the textures of the male die rollers, the associated female die recesses are not exactly inversely congruent to the male die elevations. As will still be explained further, the deviations can comprise both height or depth dimensions as well as angles.

While the elevation P1E1 and the associated depression M1R1 are semi-spherical in shape, the elevation P1E2 and the associated depression M1R1 are textured, and in this case have so-called facets F. According to Brockhaus, facets are polished surfaces and in this sense, facets in this case are defined as flat part surfaces provided on a surface. Here, the part surfaces of a surface do not have the same dimensions among them.

With respect to the mode of action and the advantages of the facets, the following physical considerations can be employed. The resolution capacity of the naked eye under ideal conditions is approximately 0.5' to 1', corresponding to 1 mm at 3-6 m or 0.1 mm at an eye distance of 30 cm to 60 cm. Similar to optical instruments, the resolution capacity is determined by the size of the pupil. The distance of the photo receptors in the fovea centralis, the location of keenest vision, is adapted to the resolution capacity of the eye, this distance amounts to approximately 0.3'. In the case of average conditions, two points are separately perceptible when their angular distance is 2'. In the case of faint objects and towards the edge of the field of vision, the visual acuity however diminishes noticeably. In contrast with this, the distinguishability of fine textures is greater. In the case of lines it can reach for example 0.3' in good contrast, which is achieved through inborn image processing in the brain.

Based on the inner liner, a reflectiveness of 20-30% must be assumed in situ, which means that in the case of a piece of film which is irradiated with white light over a large area, a maximum of 20-30% of the irradiated light intensity is reflected. Because of the only lightly metallized surface the human eye therefore requires a minimal area of approximately 0.4 mm×0.4 mm, or 0.16 $mm^2$, in order to be able to clearly distinguish small areas contrast-wise. The image processing of the brain is thus responsible for two other effects:

A) As is known from painting, complex forms can be recognised by humans when the contours and/or areas of an object are only suggestively visible.

B) For as long as the angles of curvature of an object are constant or almost constant, even larger pieces of area are recognised with the help of a few bright dots respectively constructed in the brain. Prerequisite for this is that the intensity of the reflected light supplies sufficient contrast.

As already indicated, the contrast, or the clear recognisability of free surfaces can be improved with in part elevated flat surfaces of any form, in this case called facets or polygons, which are raised on the male die roller or recessed on the female die roller. The facets mark the individual surface parts and are designed through size and arrangement that thanks to the higher specific embossing print great brilliance and thus a good aesthetic impression of the total embossing is created. This impression is created through the image processing of the human eye with the help of refraction edges, which cause a locally elevated embossing print.

As is evident from FIG. 1A, the facets F1-F4 are distributed over the relief surface 15 and are always flat approximations or part pieces of the actual relief. The height of the facet is for example between 0.02 and 0.4 mm. The result is a technique which reduces the entire print area, which supplies good aesthetic results even with limited available maximum pressure.

With the help of FIG. 2, the term "facet" is explained in more detail in a schematic and simplified manner. FIG. 2 shows a relatively large object, an "L" with a first leg length L1 of 10 mm and a second leg length L2 or 12 mm, a leg width B of 2.2 mm and a height H of 0.3 mm.

If according to the known prior art only the inner "L", i.e. according to the inner sides which perpendicularly stand on one another everywhere, were to be attached to the rollers, the film with this embossing depth would in all probability tear or with greatly reduced pressure be blurred or irregularly perceptible.

In order to both protect the film as well as increase the contrast, all sides of the character are provided with oblique faces, wherein only the oblique faces L1S, B1S, S1S and L2S are numbered here. The oblique face S1S describes a gusset arranged between a long surface and a wide surface. The angle δ between the perpendicular sides and the oblique faces is substantially determined dependent on the size of the object and the condition of the film. This angle need not be the same everywhere.

In the present case so far described, the facets created on the film consist of the oblique faces. In the case however that the facet angle δ does not satisfy the criteria described further down below, or the contrast is not satisfactory, facets FR are provided on the surface LO, see FIG. 2A. The facets FR according to FIG. 2A in this exemplary embodiment have a width BB of 0.5 mm at the base and depending on the angle ϵ, a width BT at the top of 0.3 mm, wherein the height HF amounts to 0.1 mm. This facet extends over the entire width of the character. During embossing, elevated facets are created in the film with a complementary angle ϵ.

Starting out from the described example, many variations are conceivable. For example the angles γ, and ϵ, or the height HF can vary in each case provided the criteria stated further down below are satisfied.

It is theoretically possible to attach the facets in any way, regardless of the size and shape of the same. Tests have shown however that certain criteria achieve optimal reflectiveness and thus mode of viewing an object when the following aspects are observed. Here, the angles in inclination, whether of the surface or of the lateral faces of the facet, are always based on the imaginary, continuous surface of the logo. Logo is to mean all figures or signs.

1. In order to perceive changes of the relief with a varying inclination a of under 55° the facet surfaces, which have an inclination of β=70–90°, have to be separated by at least 0.04 mm height, see FIG. 2B.
2. The surfaces of a relief with facets having a varying inclination of more than 55° are distinguishable in the case they do not exceed a length or width d, wherein d can for example amount to 0.7 mm, see FIG. 2C.
3. Facet surfaces with more than 0.7 mm in extent can distance themselves from another facet surface with another inclination angle between 70 and 90° and an oblique face 1 1 m of at least 0.5 mm. If this rule is observed, the length 1 of the surface can extend up to 30 mm and be distinguishable, see FIG. 2D.
4. In the case of a sequence of facet surfaces with inclinations of 90° each, the height h, h1 of the facets for each surface should be at least 0.04 mm, so that they are clearly recognisable, see FIG. 2E.

The above information shows that a facet is to mean a part surface that is flat as a rule, which comprises facet faces, which with respect to the imaginary and continuous surface of the logo are inclined at a defined angle.

The stated values and conditions are exemplary details, with which good results can be achieved. However it is also conceivable that other values could realise good or satisfactory results.

Since these textures are not teeth, the driving force of the male die roller driven via the belt drive 2 is transmitted to the female die roller via toothed wheels 3 and 4.

In the FIGS. 3-5, some possibilities of how the female die texture can deviate from the male die texture are schematically shown. For improved representation and illustration, the surface textures are shown tooth-shaped and enlarged in order to render the deviations better visible.

In order to be able to state the intended deviations, the systematic errors, i.e. the tolerances during the production, have to be initially defined. As already mentioned, the improvements in the roller production aim among other things at producing more accurate and suitable textures for the fine embossing, thus resulting in the problem of producing close tolerances during the production. These tolerances are among other things also influenced by the quality of the surface of the rollers and it is therefore advantageous to use a hard surface.

These can be solid hard metal rollers or metal rollers with a surface of hard metal, hardened steel or hard material such as ta-C, tungsten carbide (WC), boron carbide ($B_4C$) or silicon carbide (SiC), solid ceramic rollers or metal rollers with a ceramic surface. All these are materials which are particularly suited for precision working, for example also with a laser system. In most cases it is advantageous to provide the surface of the embossing rollers with a suitable protective layer. Both embossing rollers have roller bodies which are stiffened against deformation with a hard surface region so that the surface geometry is retained even under high loads.

For example, for an embossing roller with a length of 150 mm and a diameter of 70 mm and with the intended precision working in direction of rotation, an error of 2-4 μm and in axial direction such of +/−2 μm is aimed at and in height, with a tooth height of 0.1 mm, such of 0.5 to 3 μm. With an angle of two opposite tooth flanks of for example 80°, an angular error of under 3° is aimed at. This produces for new rollers a maximum linear error of +/−5 μm, so that the fabrication-related deviations can amount up to approximately 10 μm.

However, since these values can be greatly influenced by the measurements and the production, an intended difference can be talked of only from a linear deviation of the male die textures from the female texture of 15 μm and more in axial and radial direction and from an angular deviation of up to 20° for the total angle. The upper limit of the difference of the textures is set by the condition of the two rollers can co-operate without impairment.

The intended difference of the respective associated textures on the male die and on the female die greatly depends on the material to be embossed. Accordingly, the linear difference of the distance for the embossing of a film that is approximately 30 μm thick amounts to approximately 40 μm and during the embossing of an approximately 300 μm thick semi-cardboard, around 120 μm.

In the FIGS. 3-5 it is shown that it is advantageous for further textures if the rollers have a certain constant distance from one another. For a pin-up—pin-up roller system, such a constant distance is described in the form of a lowering of a roller, or of a smaller diameter, at least over the width of the film, by 0.02 to 0.2 mm, in WO 2011/161002 A1 of the same applicant.

In the cases according to the FIGS. 3-5, the diameter of one of the rollers, advantageously of the male die roller, is provided smaller over at least the width of the film by an amount of more than 0.02 mm than the rest of the roller. Because of this, a more even embossing can be created. In the FIGS. 3-5, such lowering, or the difference of the diameters of the male die roller is designated with 'S'.

Instead of a lowering, other spacing means can also be provided, such as for example an electronic or mechanical spacing control.

In FIG. 3, the female die roller M2 has a surface texture SM2, wherein two opposite flanks of the recesses have an angle α2. The male die roller P2 has a texture SP2, wherein two flanks of the teeth located opposite enclose an angle β2 and β2 is smaller than α2. The angles can have an amount of 10° to 110° and a difference of up to 20°.

The female die roller M3 in FIG. 4 has a female die texture SM3, the slots M3 of which have a flat slot surface. The male die P3 has a surface texture SP3, the teeth T3 of which are rounded.

The female die roller M4 from FIG. 5 has the same surface texture SM4 as previously, while the teeth T4 of male die roller P4 are flattened at the tip.

The same observations also apply to rounded textures and to the facet textures.

FIG. 6 shows a further embossing device 6, which comprises a male die roller P5 and a female die roller M5. The two rollers each have a texture P5E5 and M5R5 in the form of a wolf's head associated with one another. The remaining elements are the same as per FIG. 1.

In the FIGS. 7 and 8, an embossing device 7 with a male die roller P6 and a female die roller M6 is shown, wherein the Figures P6E6 and M6R6 are shown in the form of a stag. From the emphasised representation of FIG. 7 it is better evident that the figures on the female die roller M6 are recessed and on the male die roller P6 are raised.

FIG. 8 constitutes a detail enlargement of the male die roller P6 from FIG. 7, wherein it is evident that the stag is facetted, i.e. that the area is resolved into part areas, into facets FN. This measure substantially increases the brilliance or the reflection capability of the object on the film. If the stag were to consist of one surface, it would be conceivable under certain conditions that the image that is visible to the eye would appear irregular and accordingly blurred. By dividing the area into facetted part areas FN, the contrast of the image is increased and a visually more attractive image is created.

FIGS. 9 and 10 show two lions and a crown, which in this case are raised male die textures. On the right side the lion P7E7 is shown in its entirety wherein the facets are recognisable with relative difficulty while on the left side, in the case of the lion P7EF7, the facets are clearly visibly drawn in as in the case of a wire braiding. In FIG. 10, both lions are shown in full. The textures on the mating roller which are assigned to one another are in each case not created inversely congruently to one another.

FIG. 11 shows a further set of embossing rollers, wherein in the drawing on the left, or in the enlargement at the bottom, the male die roller P8 and correspondingly the right, or at the top in the enlargement, the female die roller M8 are shown. In particular from the enlarged representation it is evident that the depth and the width of the strokes of the lily are smaller than the depth and width of the word "dream". This symbolises that the textures, i.e. the signs and drawings and figures, can have quite different heights or depths. Here, the height of the raised reliefs need not be the same as the depth of the recesses on the female die roller.

It has also been shown that through the widening and increasing in height or deepening of the word "dream" this word is greatly emphasised, more greatly than with larger thickness, however with the same height, or depth of the lily. The widening and simultaneously heightening and deepening of a sign compared with a sign with smaller width and height, or depth brings about amplified emphasis of this sign.

In FIGS. 12 to 17 it is schematically shown that not only embossing devices with two embossing rollers but for a number of applications embossing devices with a set of embossing rollers having three embossing rollers can be practically used advantageously. Here, a male die roller can be assigned two female die rollers or a female die roller can be assigned two male die rollers. Theoretically, it is also conceivable to use a set of embossing rollers with more than three embossing rollers.

In FIG. 12, the male die roller P9 comprises two rectangles P8E1 and E2 which are arranged on top of one another and the female die rollers M9A and M9B associated recesses M9AR1 and R2, M9BR1 and R2, wherein the recesses M9AR1 and R2 have a smaller depth than the recesses M9BR1 and R2. As is indicated in FIG. 12, the three rollers co-operate in a three-roller system, wherein the elevations P8E1, E2 are arranged on the male die roller in such a manner that one elevation pair each co-operates with the associated recesses on the first and the second elevation pair with the associated recesses of the respective female roller, wherein the recesses M9AR1, R2 are less deep than the recesses M9BR1, R2.

However, it is conceivable that the male die in each case co-operates in a two-roller system firstly with the one and then with the other female die roller, wherein in each case the male die roller P9 first interacts with the female die roller M9A and then the same male die roller P9 with the other female die roller M9B.

This allows embossing of raised or deep figures without excessively straining the film. Here, tearing of the film in the locations of the deeper female die recesses can be avoided above all.

A further example of an embossing device with three embossing rollers is shown in the FIGS. 13, 13A and 13B, wherein in this case a female die roller M10 co-operates with two male die rollers P10A and P10B. While the recessed figure M10R0 of the female die roller M10 remains the same, the male die roller P10A has a relief P10A10 with a smaller height than the relief P10BE10 of the male die roller P10B.

FIG. 14 shows a further arrangement with a female die roller M11 and two male die rollers 11A and 11B. The female die roller M11 has a facetted depression M11R11, each of which is assigned to the elevation P11AEA and P11BEB, wherein the two elevations are different from one another. In order to avoid straining the films in such a manner that holes are created, embossing is first performed using the male die roller P11A, the elevation of which is smaller than that of the second male die roller P11B, with in this case more sharp-etched facets.

From the two sectional figures it is evident that the film being passed through between the embossing rollers is initially pre-embossed and subsequently embossed more deeply.

Such a multiple roller device with a female (male) die roller and multiple male (female) die rollers as mating rollers, the elevations (recesses) of which associated with one another are greater in each case from mating roller to mating roller, is used for embossing so-called elevated textures. These are arranged on top of one another and can be embossed without tearing the film, which in the case of single embossing with the same textures would lead to the tearing of the film.

Figure 1:
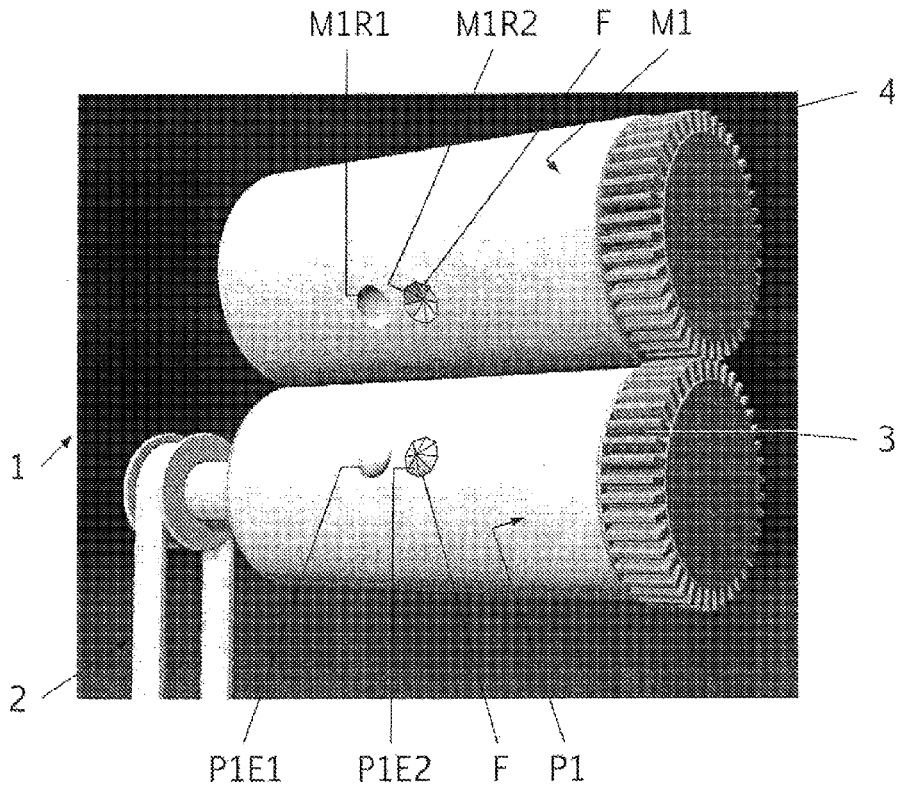
Figure 1A:
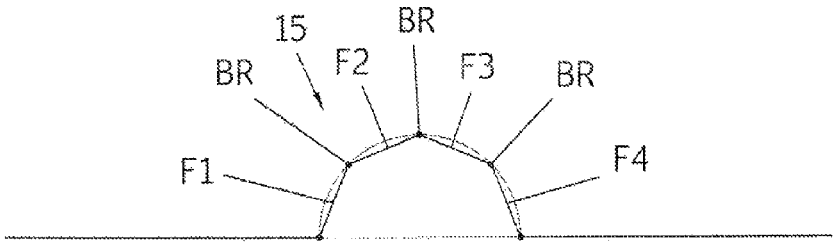
Figure 3:
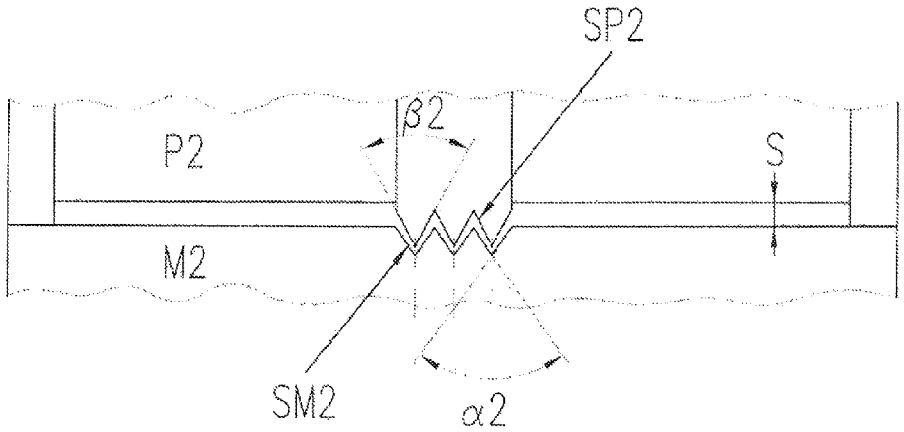
Figure 4:
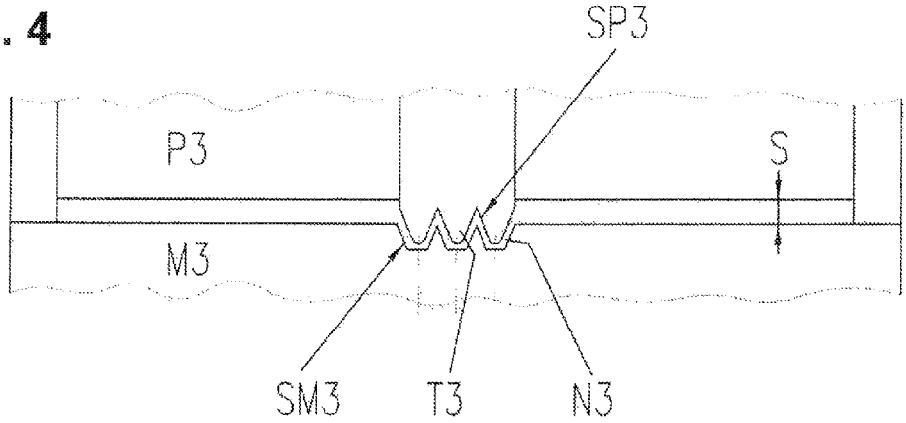
Figure 5:
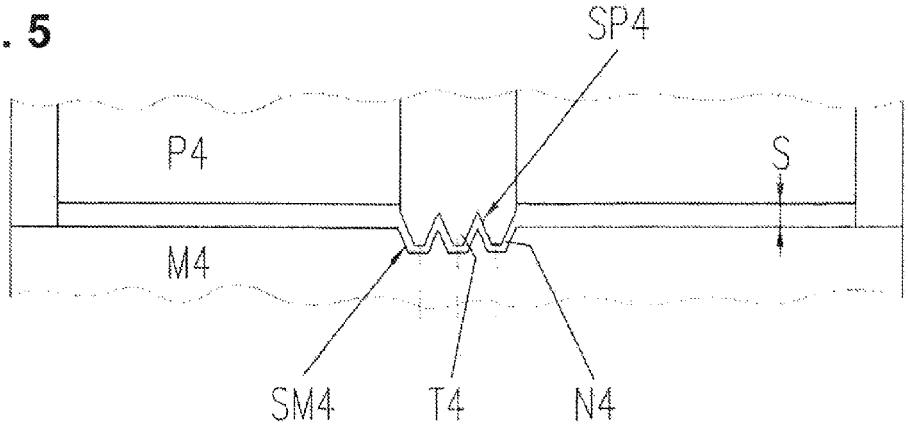
Figure 6:
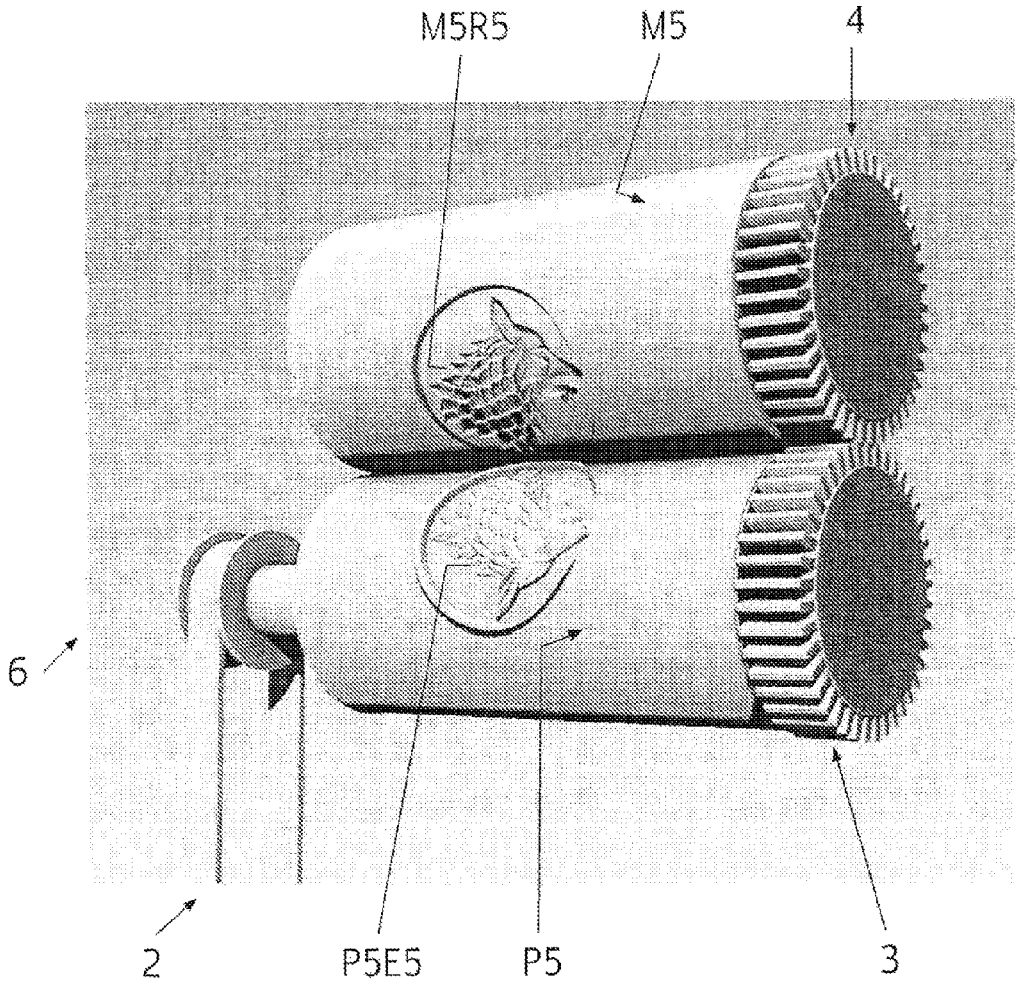
Figure 7:
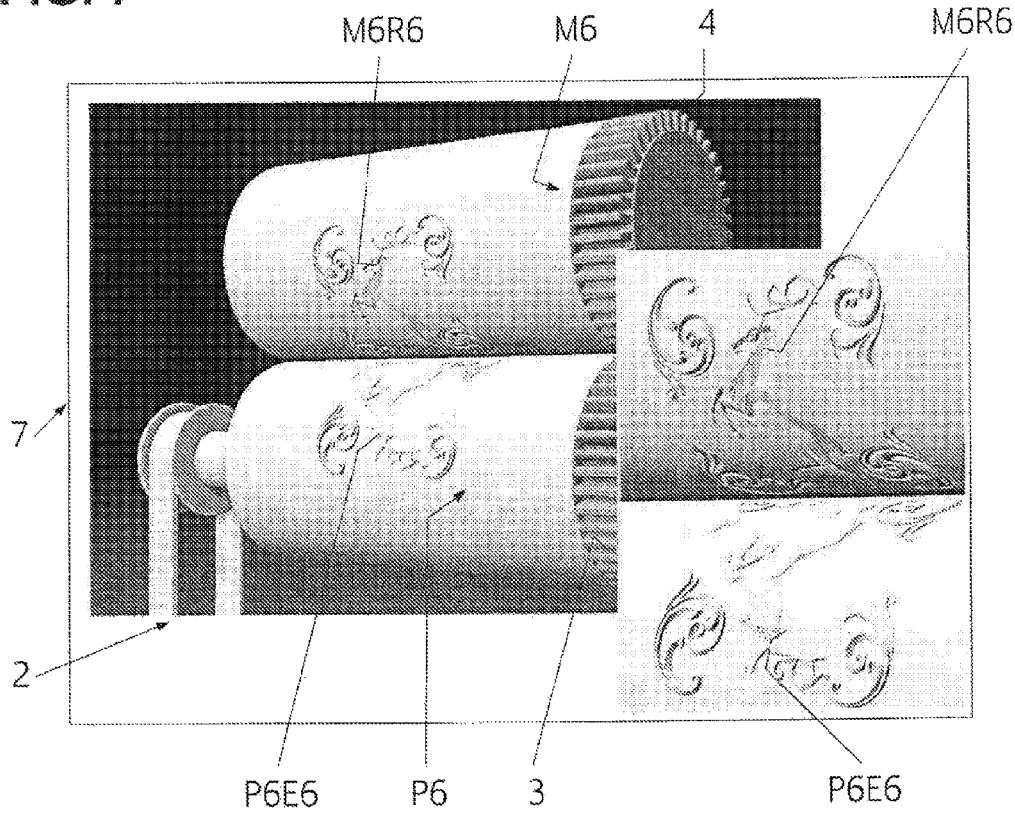
Figure 8:
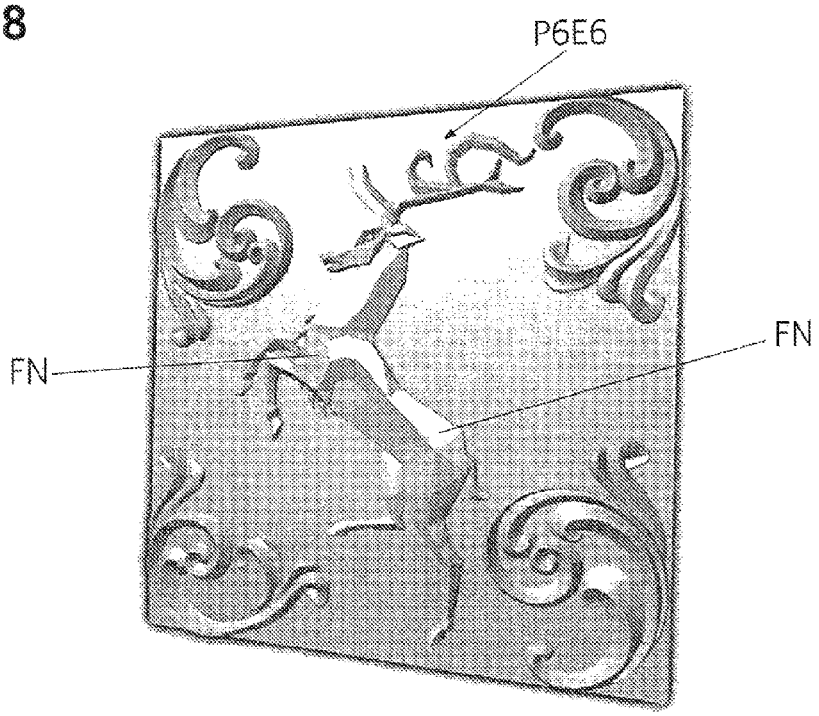
Figure 9:
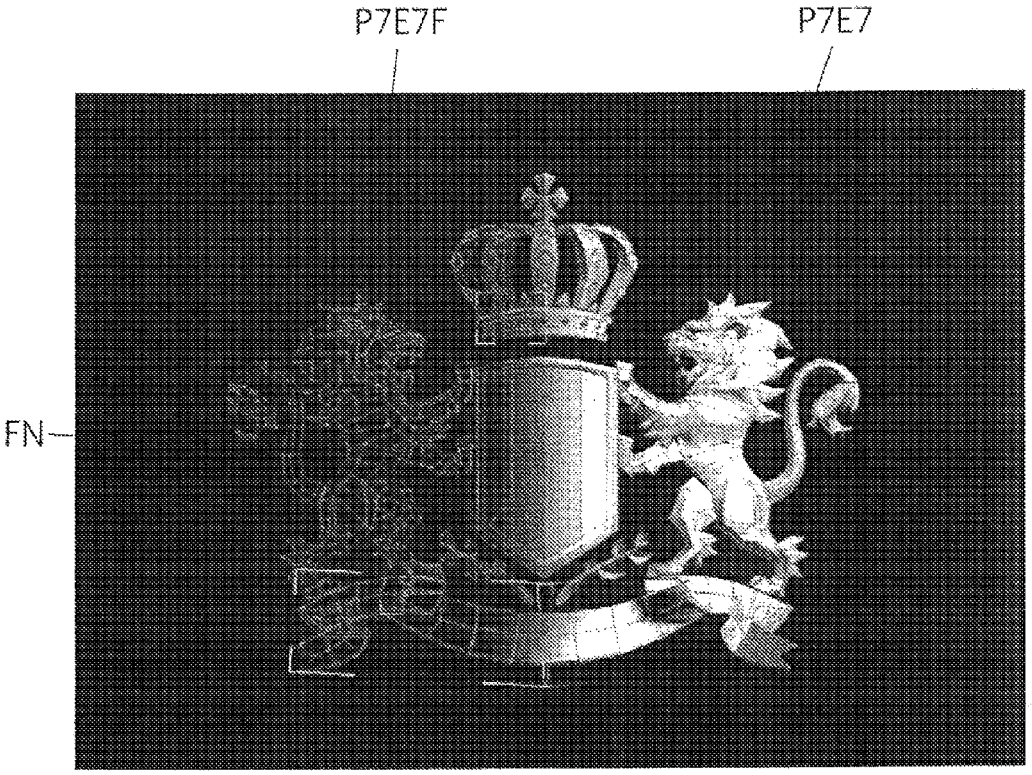
Figure 10:
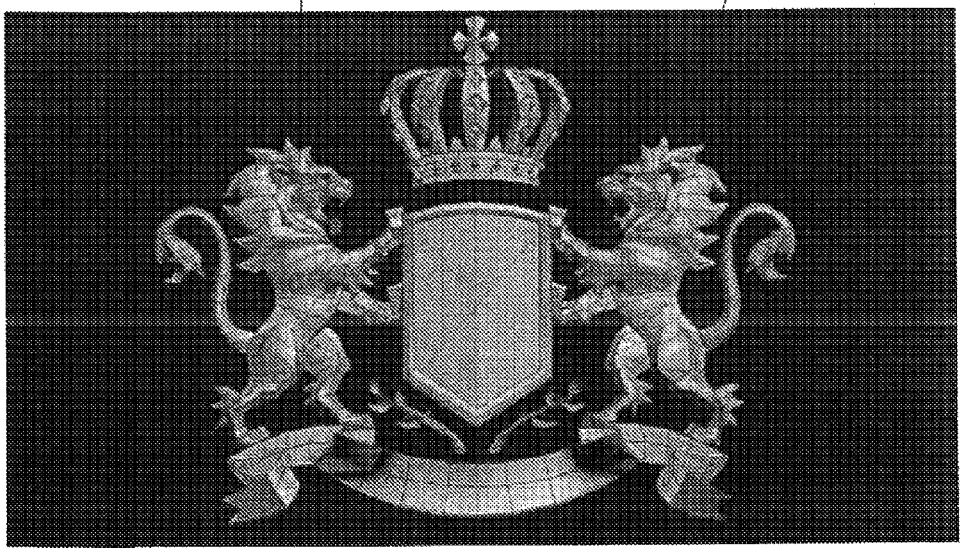
Figure 11:
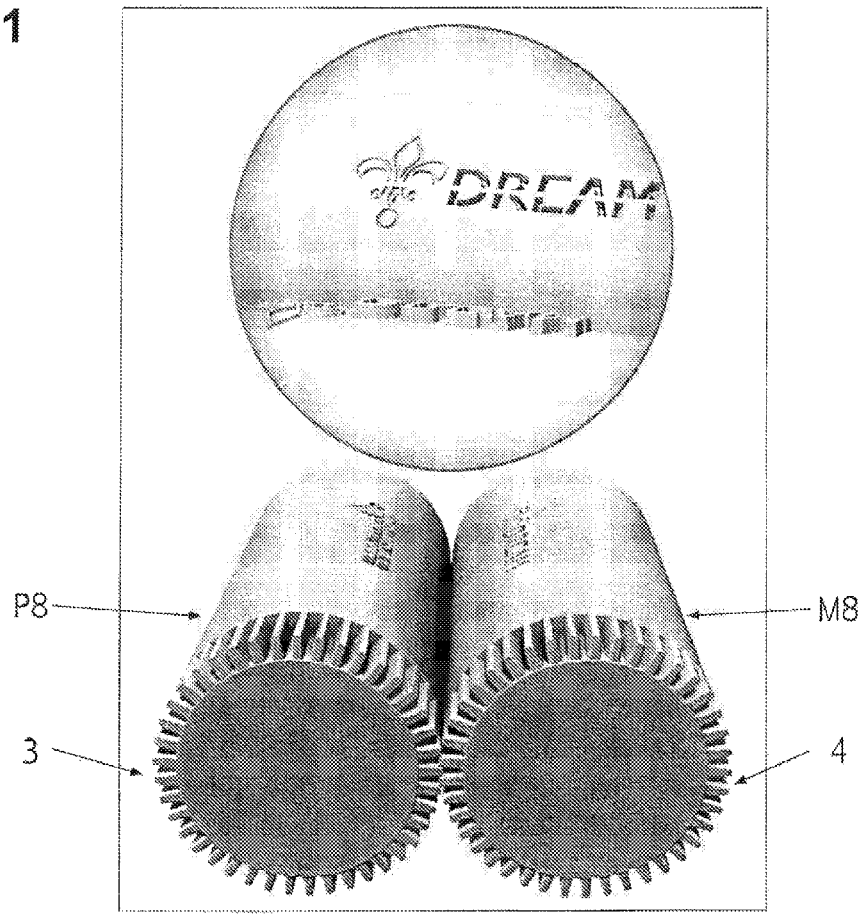
Figure 12:
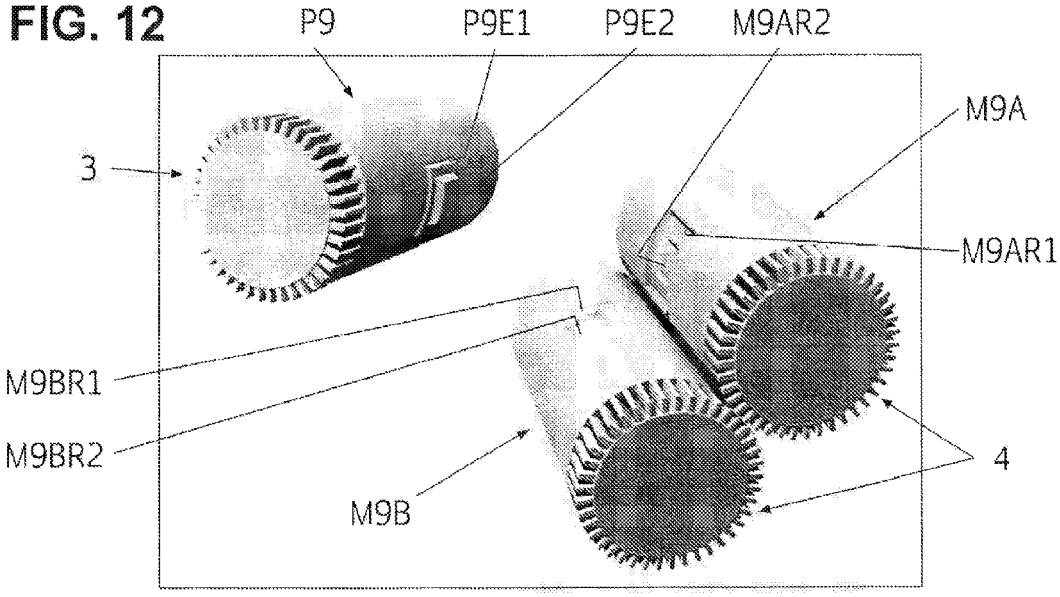
Figures 13, 13A, 13B:
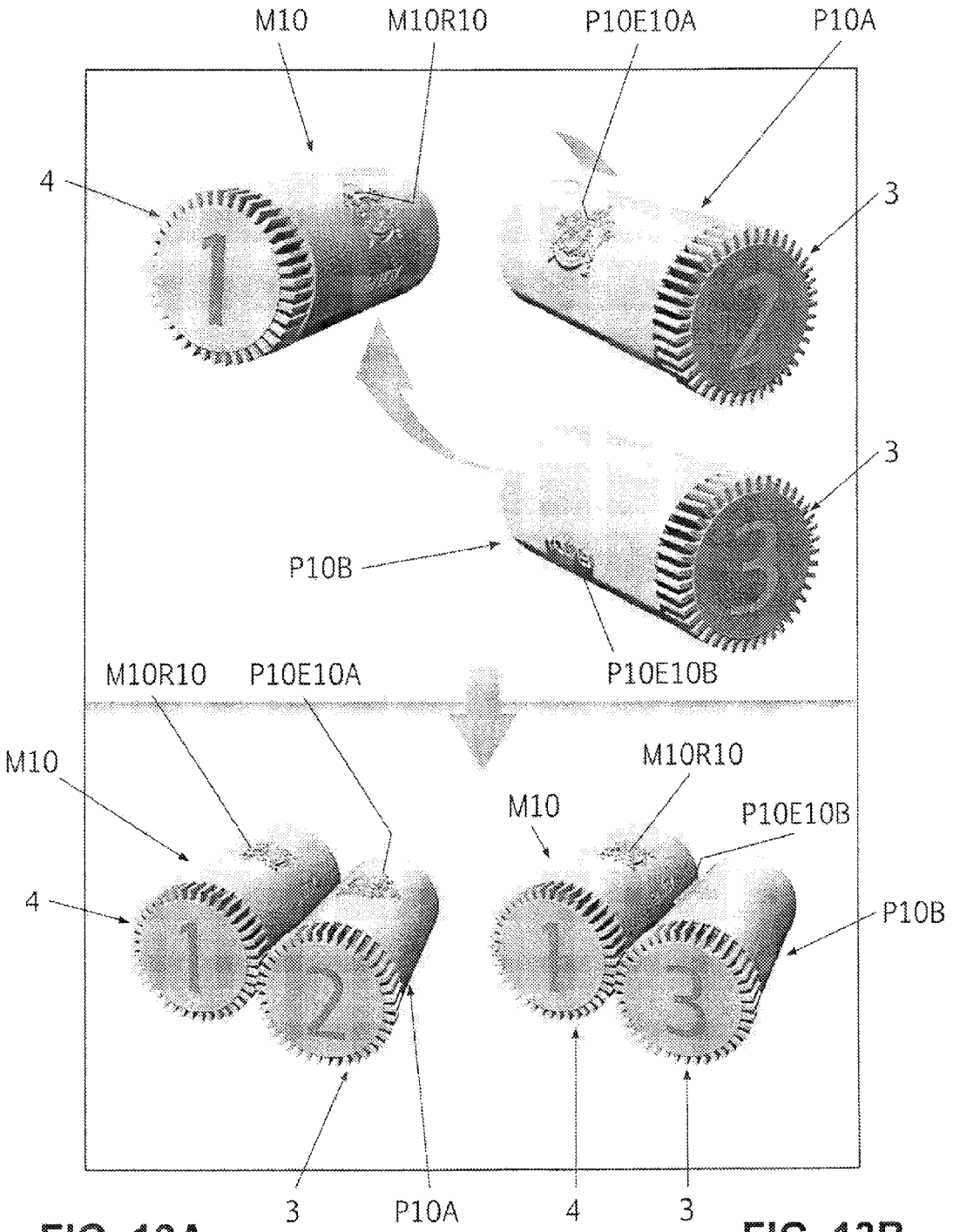
Figure 14:
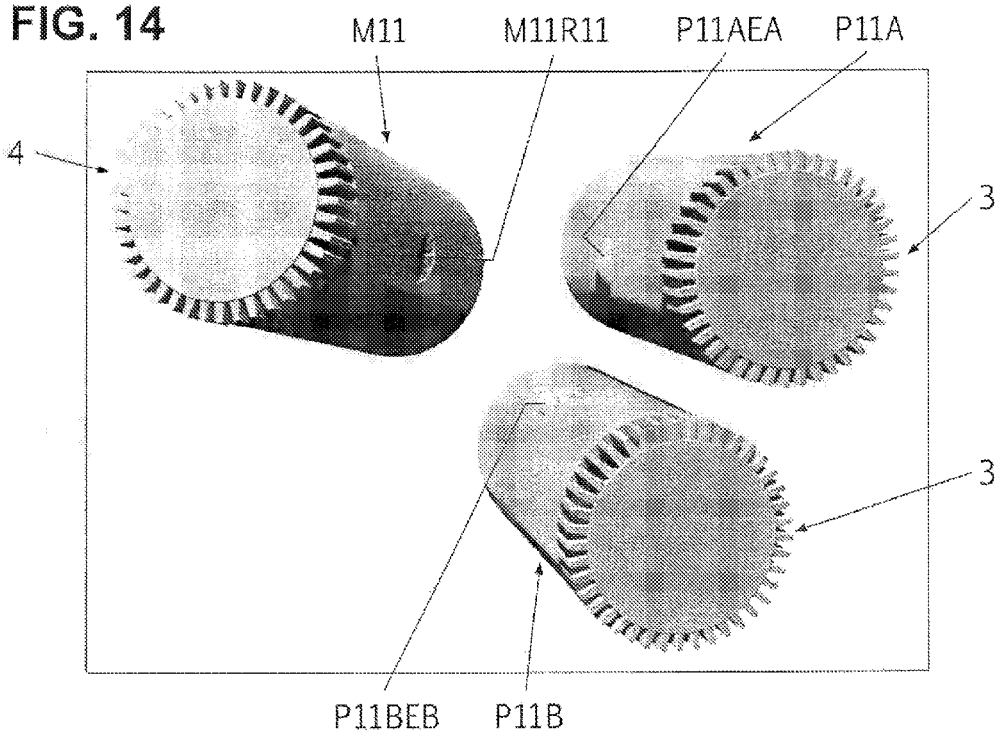
Figure 15A:
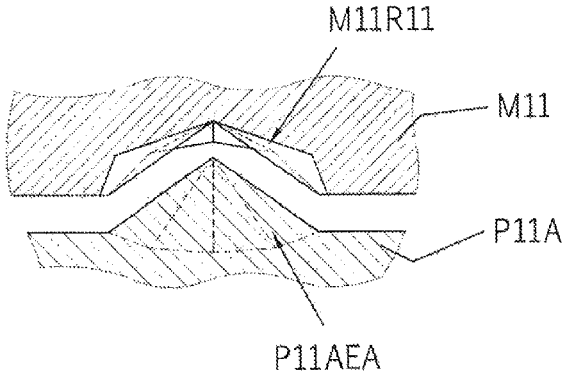
FIG. 15A shows schematically a section through the depression M11R11 of the female die roller M11 and the elevation PM11AEA of the first male die roller P11A in FIG. 14.
Figure 15B:
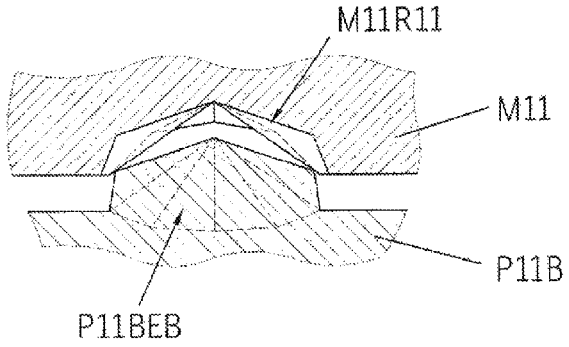
FIG. 15B shows schematically a section through the depression M11R11 of the female die roller M11 and the elevation PM11BEB of the second male die roller P11B in FIG. 14.
Figure 16:
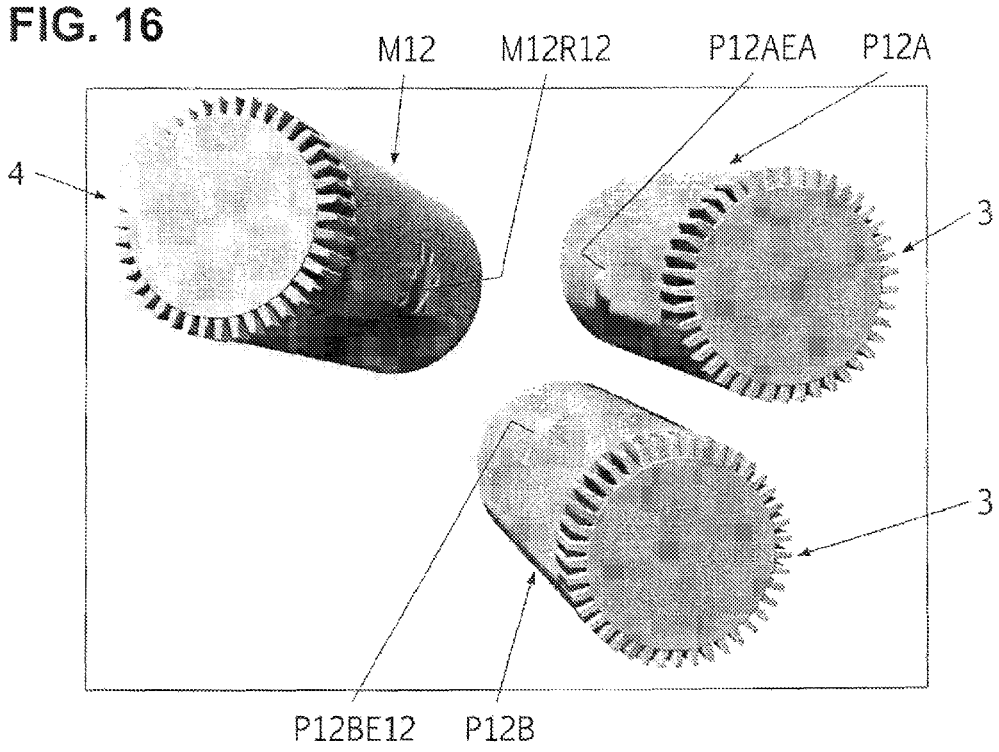

FIG. 16 shows a further arrangement with a female die roller M12 and two male die rollers 12A and 12B. The female die roller M12 has a facetted depression M12R12, which is each assigned to the elevation P12AEA and P12BEB of the male die rollers P12A and B, wherein the two elevations have heights which differ from one another. Through the successive embossing with the male die roller P12A and then with the male die roller P12B, the film during the embossing of the higher, textured relief P12BE12 is not strained to such an extent that holes are created.

Figure 17:
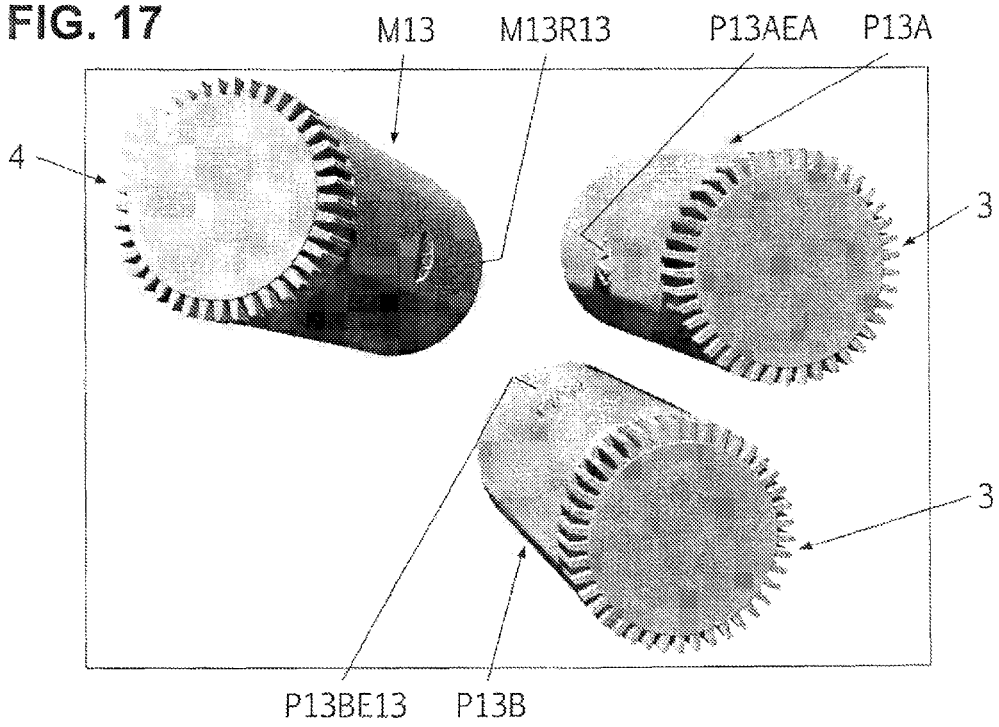

FIG. 17 shows a further arrangement with a female die roller M13 and two male die rollers P13A and P13B. The female die roller M13 has a facetted depression M13R13, which is assigned to each of the elevation P13AEA and P13BE13 of the male die rollers P13A and B, wherein the elevation P13AEA has a smaller height than the elevation P13BE13. Because of this, the film during the embossing is not strained in such a manner that holes develop.

The use of multiple rollers with elevations and recesses of different depths allows the embossing of greatly elevated reliefs without over-straining the film in such a manner that it is perforated.

Starting out from the above examples it is evident that the provision of logos of whatever shape with facets is not limited to a certain size of area, but a minimal area of 0.4 mm×0.4 mm, corresponding to 0.16 $mm^2$ and can be employed wherever a contrast improvement is desired.

The previously known male die-female die rollers were always produced in pairs and because of the fact that the female die rollers are designed inversely congruent to the male die rollers, every time one of the rollers had to be replaced, the other roller of necessity also had to be replaced. Through the individual production of the embossing rollers according to the present invention it is now possible to individually replace both the male die roller as well as the female die roller, which brings with it a major advantage not only with respect to the different wear conditions but also with respect to the configuration possibilities.

Quick-change devices for the usual pin-up—pin-up rollers are known from U.S. Pat. No. 6,665,998 of the same applicant and have been in use throughout the world for the plurality of all cigarette paper embossing devices since. The axle of the mating roller there is moveable in the three coordinate directions in order to make possible self-synchronisation of the embossing rollers. This is no longer required with the rollers of the present invention which do not have any teeth any longer.

Figure 18:
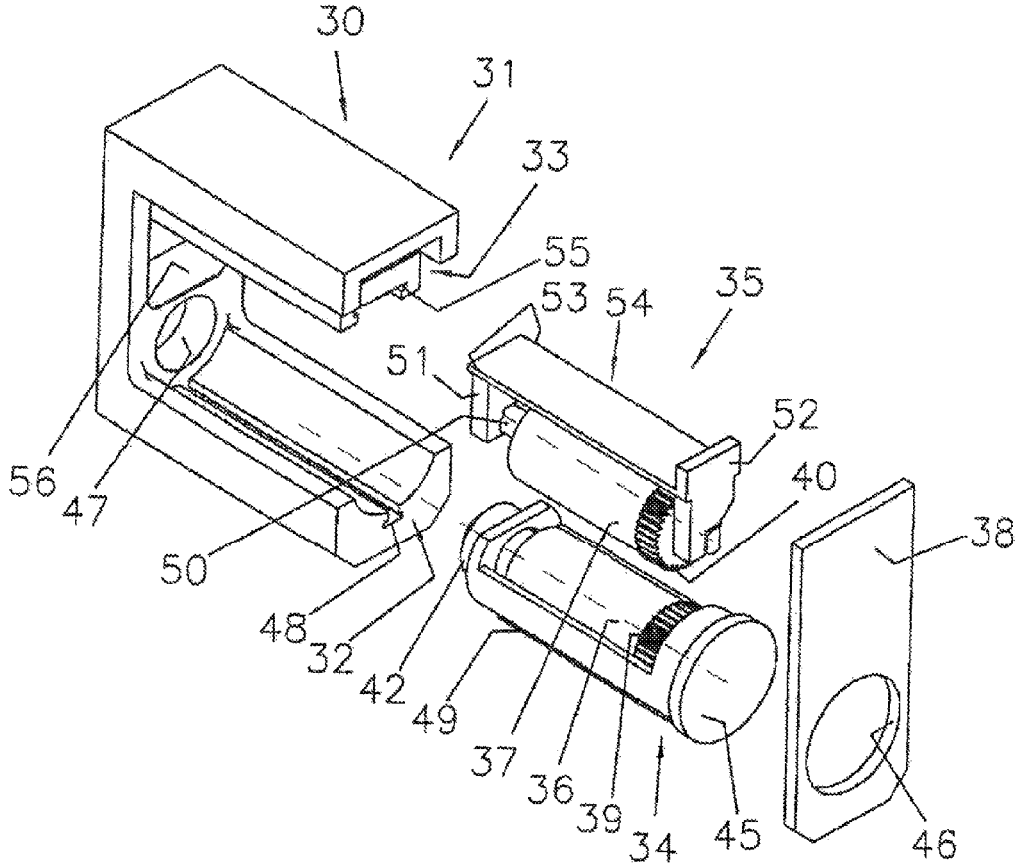
Figure 19:
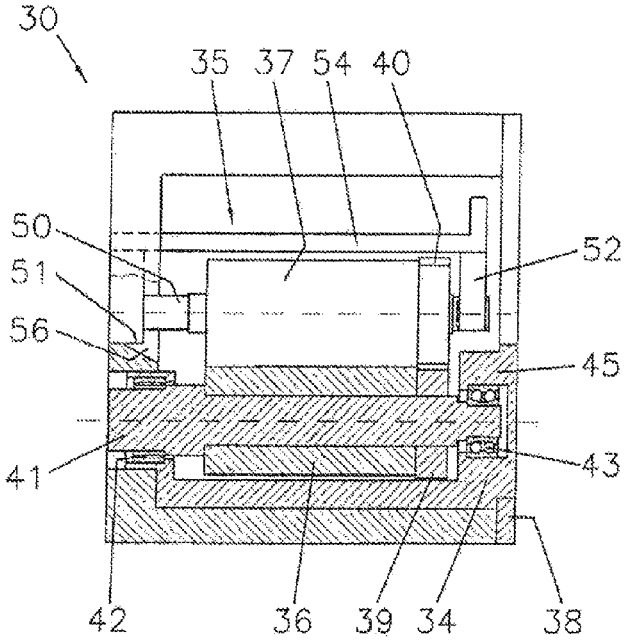

The quick-change device 30 of the FIGS. 18 and 19 includes a housing 31 with two mountings 32 and 33 for receiving a roller carrier 34 and 35 each. Roller carrier 34 serves for fastening the male die roller 36 which is driven via the drive 2 which is not shown and roller carrier 35 serves for fastening the female die roller 37. According to FIG. 20, the roller carrier 34 is pushed into the mounting 32 and roller carrier 35 into the mounting 33. The housing 31 is closed off with a termination plate 38.

In the present example, the female die roller is driven by the driven male die roller 36 in each case via toothed wheels 3 and 4, which are located at an end of the rollers. In order to ensure the demanded high precision of synchronisation, the toothed wheels are produced very finely. Other synchronisation means are also possible, e.g. electric motors.

From the section of FIG. 19 it is evident that on the external drive side, in the drawing on the left, the roller axle 41 of the male die roller 36 is rotatably held in a needle bearing 42 in the roller carrier 34 and on the other side in a ball bearing 43. The two ends 44 and 45 of the roller carrier are held in corresponding openings 46 and 47 in the housing, or termination plate. For the exact and unambiguous introduction and positioning of the roller carrier into the housing, the housing bottom comprises a T-shaped slot 48, which corresponds to a T-shaped key 49 on the roller carrier bottom.

The roller axle 50 of the female die roller 37 is mounted on one side, in the drawing on the left, in a wall 51 of the roller carrier 35 and on the other side in a second wall 52 of the roller carrier. The edges 53 of lid 54 of the roller carrier are embodied as keys which can be pushed into the corresponding T-slot 55 in the housing 31. Here, the one side wall 51 fits into a corresponding opening 56 in the housing wall. The part 57 of side wall 52 protruding over the lid fits into a recess 58 in the housing wall.

The shown versions, in the case of which the second roller is driven via toothed wheels, adjusting of the rollers following the assembly of the roller carrier is required. This is done for example with the help of the toothed wheels.

Figure 20:
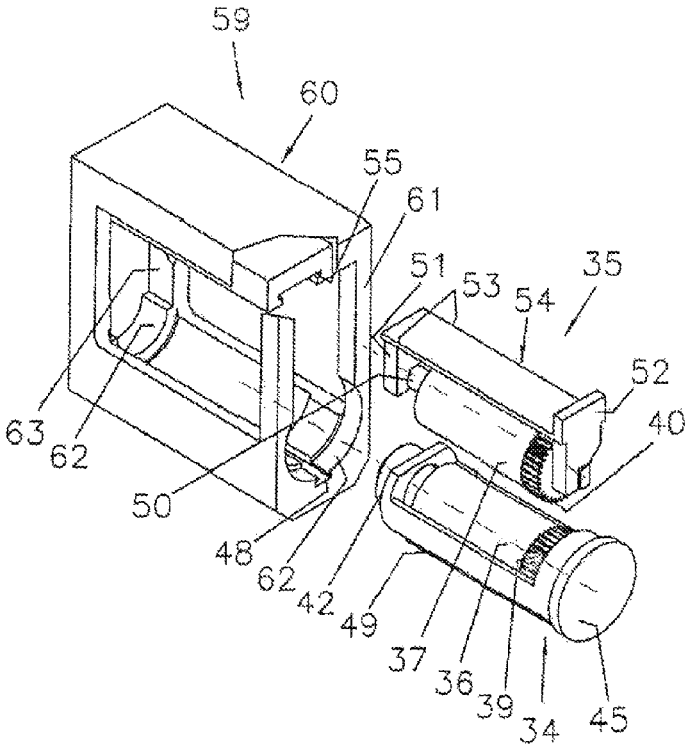

In the embodiment variant of the quick-change device 59 of FIG. 20, the housing 60 does not have a termination plate but a wall 61 with a lower half-round opening 62 and an upper approximately rectangular opening 63. The two rollers and the roller carriers are the same as before and the T-shaped slot for receiving the female die roller carrier and the T-shaped slot 48 in the housing bottom are likewise the same. The rear openings are similar to the front openings 62 and 63 in the drawing. In this embodiment, the roller carriers are also unambiguously and precisely fastened in the housing.

The use of three-roller embossing devices has been known at least since the year 2000 from WO 00/69622 of the same applicant.

The invention claimed is:

1. An embossing device for embossing packaging material comprising:

a set of embossing rollers including a male die roller and a female die roller co-operating with each other, a surface of the male die roller having texture elements, and a surface of the female die roller having texture elements, wherein the texture elements of the female die roller and the texture elements of the male die roller that are associated to the texture elements of the female die roller, include intended deviations so that a texture element of the female die roller and an associated texture element of the male die roller are not inversely congruent, the intended deviations include, an angular deviation between a side of the texture element of the female die roller and an associated side of the texture element of the male die roller being up to 20°, and a linear deviation between the texture element of the female die roller and an associated texture element of the male die roller being above 15 μm in an axial and a radial direction, and wherein the texture elements of the male die roller, which are assigned to the texture elements of the female die roller, have facets configured to increase a local pressure.

2. The embossing device according to claim 1, wherein each of the facets have faces which are inclined at a defined angle, with respect to an imaginary and continuous surface of a texture of a logo represented by the texture elements.

3. The embossing device according to claim 1, wherein a minimal area for each of the facets is 0.4 mm×0.4 mm, or 0.16 $mm^2$.

4. The embossing device according to claim 1, further comprising:

a second female die roller, wherein the male die roller, the female die roller, and the second female die roller are arranged such that the male die roller with a male die elevation first interacts with the female die roller with an associated first female die depression, and thereafter the male die roller with the male die elevation interacts with the second female die roller and an associated second female die depression.

5. The embossing device according to claim 1, further comprising:

a second male die roller, wherein the male die roller, the second male die roller, and the female die roller are arranged such that the female die roller with a female die depression first interacts with the male die roller with an associated male die elevation, and thereafter the female die roller with the female die depression interacts with the second male die roller with an associated second male die elevation.

6. The embossing device according to claim 4, wherein the male die roller, the female die roller, and the second female die roller are arranged in a three-roller embossing device, wherein the male die elevation is arranged on the male die roller in such a manner that during an embossing process, the male die elevation interacts first with recesses of the female die roller, and thereafter with recesses of the second female die roller.

7. The embossing device according to claim 4, wherein the male die roller, the female die roller, and the second female die roller are each arranged in pairs in a two-roller embossing device.

8. The embossing device according to claim 5, wherein the male die roller, the second male die roller, and the female die roller are arranged in a three-roller embossing device, wherein the female die depression is arranged on the female die roller in such a manner that during an embossing process, the female die depression interacts first with elevations of the male die roller, and thereafter with elevations of the second male die roller.

9. The embossing device according to claim 5, wherein the male die roller, the second male die roller, and the female die roller are each arranged in pairs in a two-roller embossing device.

10. The embossing device according to claim 1, wherein at least one of a height and a depth of the elevations and recesses and a number of embossing rollers are configured to create high or raised reliefs on the packaging material through multiple embossing, the at least one of the height and the depth and width being greater than remaining textures of the packaging material.

11. The embossing device according to claim 1, wherein a diameter of one of the embossing rollers is wider than the width of a web of the packaging material, the diameter being smaller by an amount S than the other embossing roller, wherein S has a value of over 0.02 mm.

12. The embossing device according to claim 1, wherein the surface of the embossing rollers is made of at least one of metal, hard metal, hard material, and ceramic, and wherein the surface is covered by a protection layer.

13. The embossing device according to claim 1, wherein the set of embossing rollers is arranged in a quick-change device such that the male die roller and the female die roller can be replaced individually and independently of each other, wherein the male die roller and the female die roller are rotatably held in a male die roller carrier and a female die roller carrier, respectively, and are fastened individually and removably independently from each other in a quick-change housing in a defined position, wherein an end of the male die roller carrier is held in a needle bearing and an other end of the male die roller carrier is held in a ball bearing.

14. The embossing device according to claim 13, wherein at least one of the male die roller carrier and the female die roller carrier includes a key at a lower part, and a corresponding slot at a bottom of the quick-change housing.

15. The embossing device according to claim 1, wherein the linear deviation between the texture element of the female die roller and the associated texture element of the male die roller is approximately 40 μm in an axial and a radial direction.

16. The embossing device according to claim 1, wherein the linear deviation between the texture element of the female die roller and the associated texture element of the male die roller is approximately 120 μm in an axial and a radial direction.

* * * * *